US006851801B2

(12) United States Patent
Niikura

(10) Patent No.: US 6,851,801 B2
(45) Date of Patent: Feb. 8, 2005

(54) RECORDING MATERIAL CONVEYING DEVICE AND INK JET RECORDING APPARATUS USING SUCH DEVICE

(75) Inventor: Takeji Niikura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 10/218,451

(22) Filed: Aug. 15, 2002

(65) Prior Publication Data

US 2003/0043247 A1 Mar. 6, 2003

(30) Foreign Application Priority Data

Aug. 29, 2001 (JP) ..... 2001/259393

(51) Int. Cl.[7] ..... B41J 2/01

(52) U.S. Cl. ..... 347/104; 400/636; 400/641

(58) Field of Search ..... 347/104; 400/636, 400/641, 637, 636.3; 271/273

(56) References Cited

U.S. PATENT DOCUMENTS 5,606,357 A 2/1997 Bekki
6,276,680 B1 8/2001 Sonoda et al.

*Primary Examiner*—Stephen D. Meier
*Assistant Examiner*—Ly Tran
(74) *Attorney, Agent, or Firm*—Fitzpatrick, Cella, Harper & Scinto

(57) ABSTRACT

A recording material conveying device is provided with a pair of rotational members for conveying a recording material, and for one of the rotational members, an escape portion is formed for an opening portion of a bearing hole thereof and that satisfies a condition of $\alpha \leqq \beta$, where an angle formed by the axial core of the axial member supporting the rotational member and the center of the bearing hole for bearing the axial member is $\alpha$, and an angle formed by the center of the bearing hole and the escape portion of the bearing hole is $\beta$. With the structure thus arranged, it becomes possible to prevent a recording material from being damaged or stained, or be otherwise adversely affected, by use of an expeller rotational member, while performing a stabilized conveyance of a recording material without increasing costs.

12 Claims, 9 Drawing Sheets

RECORDING MATERIAL CONVEYING DEVICE AND INK JET RECORDING APPARATUS USING SUCH DEVICE

BACKGROUND OF THE INVENTION

1. Field of the Invention

The present invention relates to an ink jet recording apparatus that records by discharging ink droplets to a recording material. More particularly, the invention relates to a conveying device of a recording material, which is capable of significantly reducing the adhesion of the contact marks on the recording material that may be made by the rotational member when carrying out the expelling conveyance of the recording material by keeping contact with the recording surface of the recording material after ink jet recording, and which is also capable of attempting the stabilized conveyance of a recording material. The invention also relates to an ink jet recording apparatus that uses such device.

2. Related Background Art

The recording apparatus provided with the function of a printer, a copying machine, a facsimile, or the like, or used as the output equipment of complex electronic equipment or a work station, which includes a computer, word processor, or the like, is arranged to record on a recording material (recording medium) such as a paper sheet, a thin plastic sheet, in accordance with image information.

Of such recording apparatuses, an ink jet recording apparatus has problems given below.

For example, when recording is made on the trailing end portion of a recording material, and then, the recording material is being expelled, the conveyance thereof becomes unstable in a case where a recording material having a high rigidity is used or a large curling occurs at the time of recording or in a case where the recording material is conveyed at ultra-high speed.

Generally, in an ink jet recording apparatus, a structure is arranged to eject (expel) a recording material after recording in such a manner that an expelling conveyance roller, which is in contact with the backside of a recording material under pressure, and a rotational member (hereinafter referred to as a "spur") that has plural extrusions on the circumference thereof as shown in FIG. 11A are arranged so that the spur is in contact with the recording surface side and made rotative following the rotation of the expelling conveyance roller, and that the recording material after recording is expelled by rotating the extrusions thereof, which are in contact under pressure on the surface having the adhesion of ink droplets.

Now, if the biasing pressure of the spur to a recording material in order to effectuate the stable conveyance thereof, the rotation load to the spur is increased by the pressure thus increased in addition to the causes brought about directly by the increased pressure in some cases. FIG. 10 shows the conventional structure, and when the amount of deformation (a warping amount) of the spur spring 37 is conditioned to be approximately 1 mm, it is in contact with the inner circumference of the spur 36 on the edge portion 37*b* on the inner side when the edge portion 37*a* on the outer side is biased. Then, the rotational load on the spur 36 becomes large.

The increased rotational load on the spur such as this impedes the normal rotation of the spur eventually, and the spur causes damage to the recording material. If the recording material is such that it has a surface coating layer, the problem encountered is such as to peel off the coating layer.

Also, as a driven-rotational member (roller) for use of a sheet expeller of the kind, there is a rotational member having curved circumferential surface (hereinafter referred to as a "rotational member with curved circumferential surface"), which is continuously in contact with a recording material by a contact area of as small as possible as shown in FIG. 11B. Even with the rotational member with curved circumferential surface, a recording material is damaged more or less as described above in a condition that the rotational member is forced to be in contact therewith under a strong pressure due to defective rotation. There is a problem encountered that transferred ink or the coating layer is peeled off.

Further, if a countermeasure is taken respectively for the rotational member with curved circumferential surface and the spur-rotational member to increase the number of rotational members instead of intensifying the biasing pressure to a recording material, there is a problem encountered that such countermeasure leads to a significant increase of costs.

SUMMARY OF THE INVENTION

The present invention is designed in consideration of the technical problems discussed above. It is an object of the invention to provide a recording material conveying device capable of preventing a recording material from being damaged, stained, or otherwise degraded by use of an expeller rotational member without increasing costs, while performing the stabilized conveyance of a recording material, and also, to provide an ink jet recording apparatus that uses such device.

It is another object of the invention to provide a recording material conveying device having a pair of rotational members for conveying a recording material, and for one of the rotational members, an escape portion is formed for the opening portion of the bearing hole of the aforesaid rotational member in a condition of $\alpha \leqq \beta$ where an angle formed by the axial core of the axial member supporting the rotational member and the center of the bearing hole for bearing the axial member is $\alpha$, and an angle formed by the center of the bearing hole and the escape portion of the bearing hole is $\beta$, and also, to provide an ink jet recording apparatus that uses such device.

It is still another object of the invention to provide a recording material conveying device having a driving roller for conveying a recording material and a driven roller, and for the driven roller, an escape portion is formed for the opening portion of the bearing hole of the aforesaid driven roller in a condition of $\alpha \leqq \beta$ at the contact point between the driven roller and the axial member where an angle formed by the axial core of the axial member supporting the aforesaid driven roller and the center of the bearing hole for bearing the axial member is $\alpha$, and an angle formed by the center of the bearing hole and the escape portion provided for the bearing hole is $\beta$, and also, to provide an ink jet recording apparatus that uses such device.

DETAILED DESCRIPTION OF THE PREFERRED EMBODIMENTS

Figure 11A:
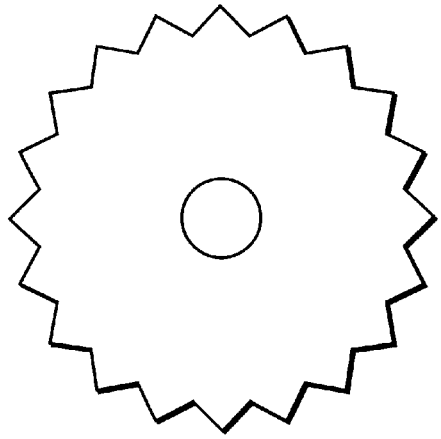
FIGS. 11A and 11B are side views that illustrate rotational members for use in a sheet expeller.
Figure 11B:
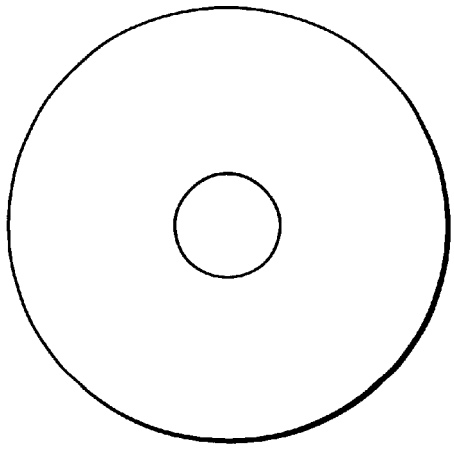

Hereinafter with reference to the accompanying drawings, the specific description will be made of the embodiments in accordance with the present invention. Here, for the present embodiment, the description will be made of the structure in which the spur type rotational member (spur) as shown in FIG. 11A is arranged to be able to contact with a recording material on the recording surface side, and also, arranged to be able to rotate following the rotation of an expelling conveyance roller. However, the present invention is not necessarily limited thereto. It is also preferably applicable to the structure in which a rotational member with a curved circumferential surface as shown in FIG. 11B is arranged in the position where the aforesaid spur is provided.

Figure 1:
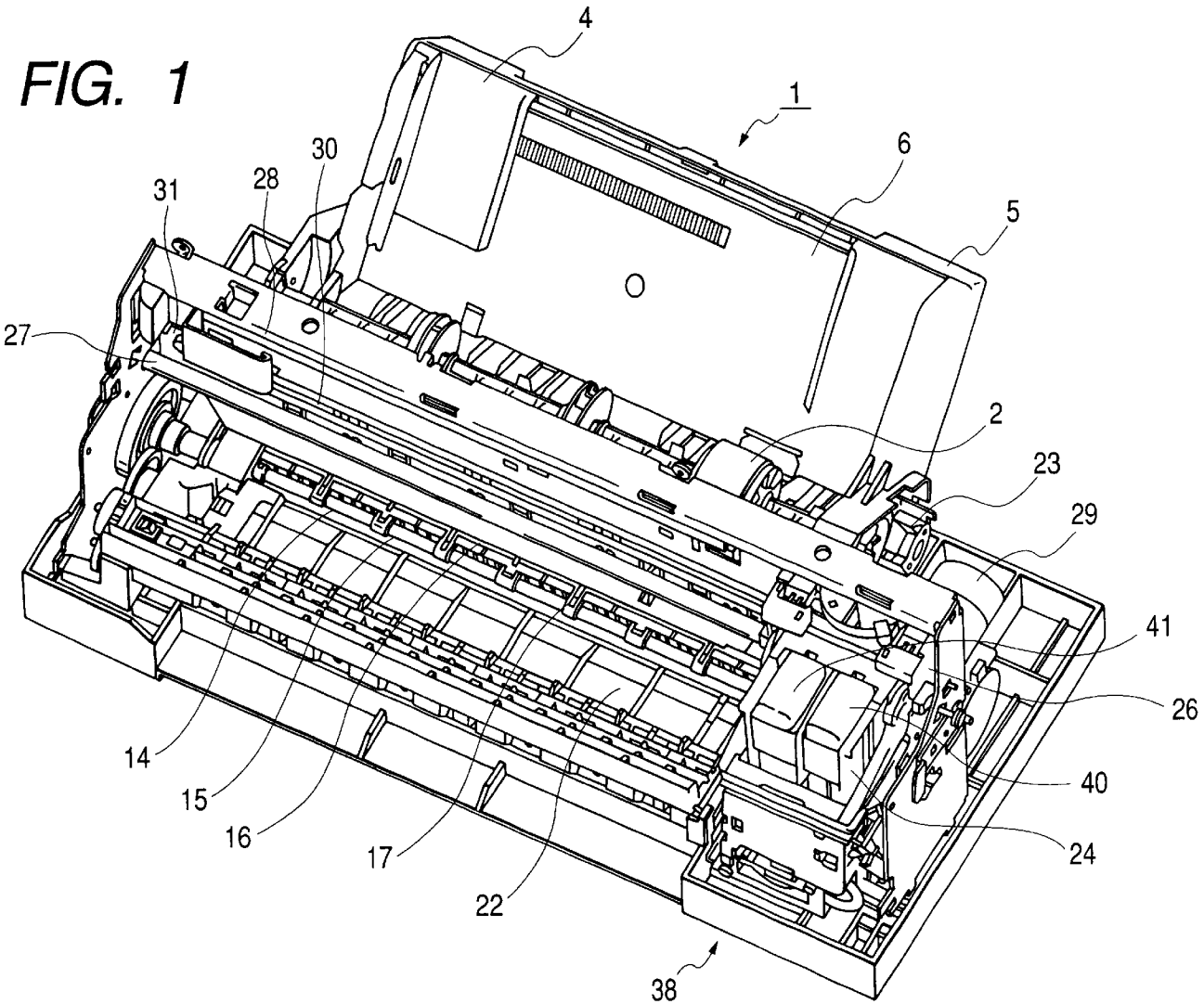
FIG. 1 is a perspective view that schematically shows the structure of an ink jet recording apparatus in accordance of one embodiment of the present invention.
Figure 2:
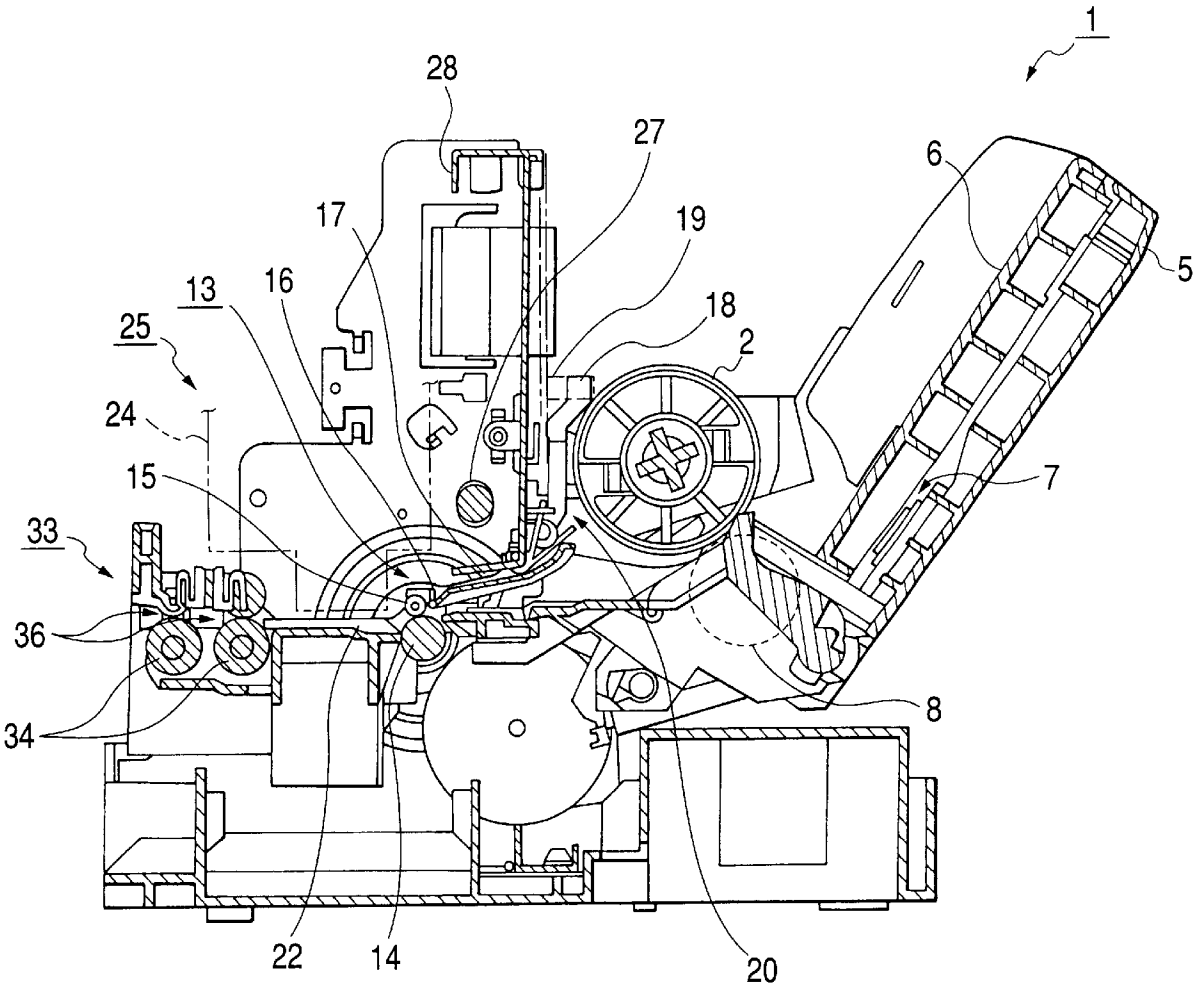
FIG. 2 is a vertically sectional view that shows the ink jet recording apparatus represented in FIG. 1.

At first, in describing the spur structure of the present embodiment, the description will be made of the schematic structure of an ink jet recording apparatus to which the spur structure is applicable in conjunction with FIG. 1 and FIG. 2. FIG. 1 is a perspective view that illustrates the ink jet recording apparatus main body of the preferable example embodying the present invention, which is in a state where the upper part cover thereof is removed. FIG. 2 is a cross-sectional view that shows the principal components of the ink jet recording apparatus main body to which the present invention is preferably applicable.

The ink jet recording apparatus of the present embodiment is a recording apparatus integrally formed with an automatic sheet-feeding device (automatic sheet feeder: ASF), and as shown in FIG. 1 and FIG. 2, the apparatus is provided with a sheet feeding portion 1, a conveying portion 13, an expeller portion 33, a carriage 25, a cleaning portion 38, and others.

The sheet-feeding portion 1 is fixed to the apparatus main body with an inclination of 30 degrees to 60 degrees to the setting face of the apparatus main body, and the structure is arranged so that recording material (recording sheet) P set at this portion is expelled horizontally after recording. The sheet-feeding portion 1 is provided with a sheet-feeding roller 2, a movable side guide 4, a frame 5, a pressure plate 6, a pressure plate spring 7, a driving gear train 23, and the like.

By means of the cam connected with the driving gear train 23, the pressure plate 6 moves up and down to effectuate the contact between the recording material P and the sheet-feeding roller 2 or to part them from each other, while separating recording sheets (recording material) one by one in such a manner that the recording material P is picked up along the rotation of the sheet-feeding roller 2 and also, by use of the retard roller 8 having a torque limiter incorporated therein. The recording material P thus separated is conveyed to the conveying portion 13 to be described later. The sheet-feeding roller 2 and the aforesaid cam rotate once so as to feed the recording material P to the conveying portion 13, and then, driving is switched to the sheet-feeding roller 2 again in a state where the pressure plate 6 is released from the sheet-feeding roller 2, thus keeping this initial condition (status at the earlier stage).

The conveying portion 13 is provided with a conveying roller 14, a pinch roller 15, a pinch roller guide 16, a pinch roller spring 17, a PE sensor lever 18, PE sensor 19, a PE sensor spring 20, a platen 22, and others. The recording material P that has been conveyed to the conveying portion 13 is guided by the platen 22 and the pinch roller guide 16, and then transferred to a nipping portion formed by the conveying roller 14 and the pinch roller 15. On the upstream side of the roller pair 14 and 15 in the recording material conveying direction, there is arranged the PE sensor lever 18 to detect the leading end of the recording material P to provide the criterion to establish the starting position of recording on the recording material P.

The pinch roller 15 is pressed to the conveying roller 14 by the pinch roller spring 17 that biases the pinch roller guide 16, thus being driven following the rotation of the conveying roller 14 to generate a force to convey the recording material P. The recording material P that has been conveyed through a gap between the conveying roller 14 and the pinch roller 15 enables an LF motor (not shown) to be driven for the rotation of the conveying roller 14 and the pinch roller 15, thus being conveyed in a designated amount to the starting position of the recording on the platen 22. Then, recording is performed by use of a recording head 24 in accordance with given image information.

The recording head 24 records ink images on the recording material P thus conveyed by use of the conveying roller 14 and the pinch roller 15. Recoding means of this apparatus uses the ink jet recording method that records by discharging ink from the recording head 24. In other words, the recording head is provided with fine liquid discharge ports (orifices), liquid paths, an energy activating portion installed in part of each flow path, and energy generating means installed in the activating portion, which generates liquid droplet formation energy.

For energy generating means that generates energy of that kind, there is a recording method that uses an electromechanical converting element, such as a piezoelectric element, a recording method that uses energy generating means for discharging liquid droplets by the action of heat generated by the irradiation of electromagnetic waves, such as by a laser, or a recording method that uses thermal energy generating means for discharging liquid by heating liquid with an electrothermal converting element, such as a heat generating element having a heat generating resistive member, or the like. Among them, an ink jet recording head that discharges liquid by the application of thermal energy, the heat generating resistive member of which can be formed using the semiconductor manufacturing technologies and techniques, has an advantage in that it is easier to arrange discharge ports at high density at lower costs of manufacture.

The carriage portion 25 is provided with a carriage 26 for installing the recording head 24; a guide shaft 27 for enabling the carriage 26 to reciprocate for scanning (main scanning) in the directions intersecting with (for example, at right angles to) the direction of conveying a recording material (sub-scanning direction); a guide rail 28 that holds the rear end of the carriage 26 to keep a distance between the recording head 24 and the recording material P; a timing belt 30 that transmits the driving power of a carriage motor 29 to the carriage 26; an idle pulley 31 that gives tension to the timing belt 30; and a flexible cable (not shown) for transmitting head driving signals from an electric base plate (not shown) to the recording head 24, among some other components. The recording head 24 is structured as a separate member from ink tanks 40 and 41. The ink tanks are exchangeable. The recording head scans together with the carriage 26 and records ink images on the recording material P, which is conveyed on the platen 22.

The expeller portion 33 is provided with at least one expelling roller 34; transmission gears (not shown) that transmit the driving of the conveying roller 14 to the expelling roller 34; a spur 36 that supports to expel a recording material P; an expeller tray (not shown); and some other components. By use of the expelling roller 34 and the spur 36, the recording material P after recording is expelled to the expeller tray (not shown) without staining the image-recorded surface thereof.

The cleaning portion 38 is provided with a tube pump (not shown) used for cleaning the recording head 24; a cap (not shown) used for preventing the liquid discharge ports (orifices) of the recording head 24 from being dried; a gear train (not shown) that transmits the driving of the conveying roller 14 to the pump (not shown); and some other components. Except when cleaning is performed, the gear train (not shown) does not transmit the driving of the conveying roller 14 to the tube pump (not shown) by use of switching means provided for the cleaning portion 38.

Also, for the LF motor (not shown) that drives the conveying roller 14 and other components, a stepping motor is used, which rotates at a given angle in accordance with signals transmitted from a driver (not shown). On the other hand, the carriage motor 29 that drives the carriage 26 is a DC motor, which detects slits of a scale by means of a linear encoder, and performs the positional control of the carriage using feedback thus made available.

With the structure described above, it is made possible for the recording apparatus main body to execute the recording sequence of sheet feeding, recording, and expeller operation, as well as the protection of the recording head.

Figure 3:
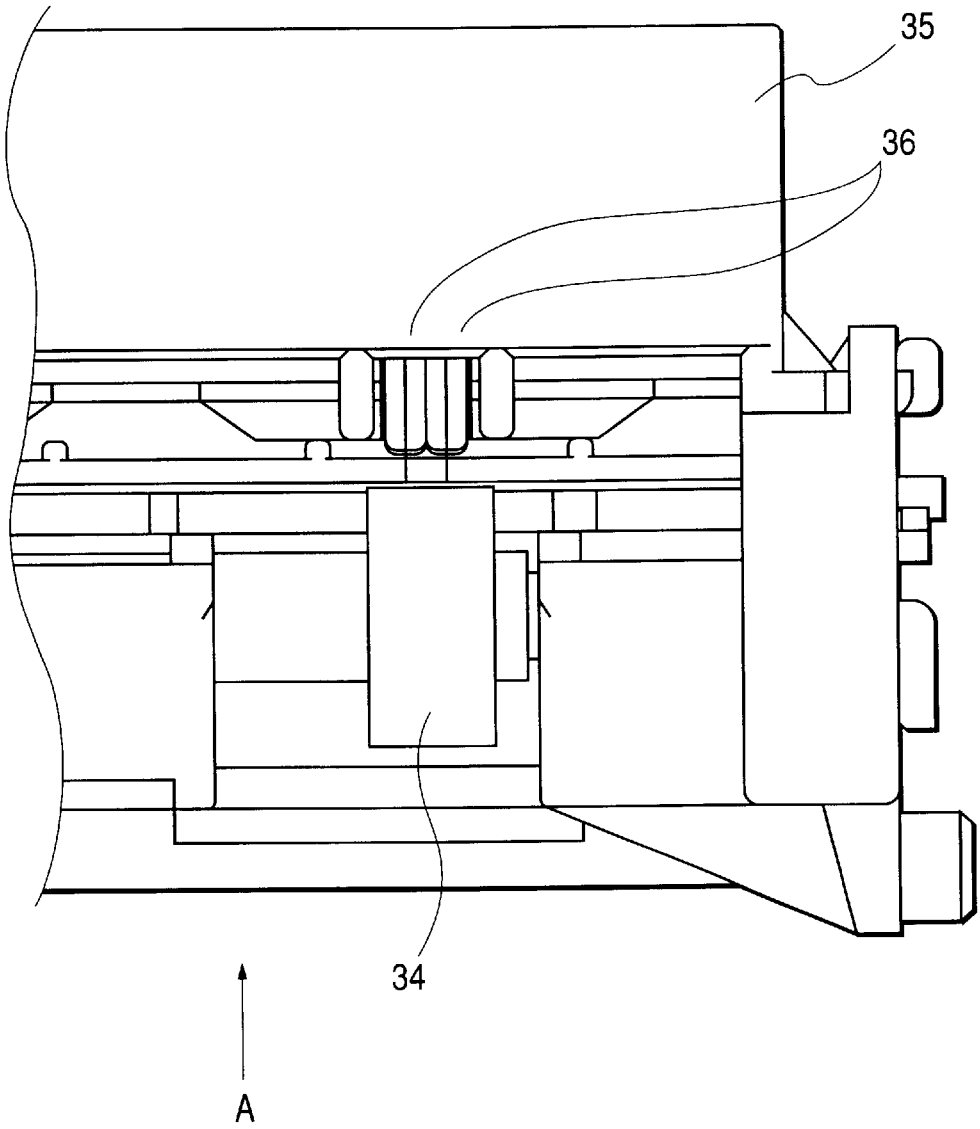
FIG. 3 is a view that schematically shows the expeller portion of the ink jet recording apparatus represented in FIG. 1, observed from the front side of the recording apparatus.
Figure 4:
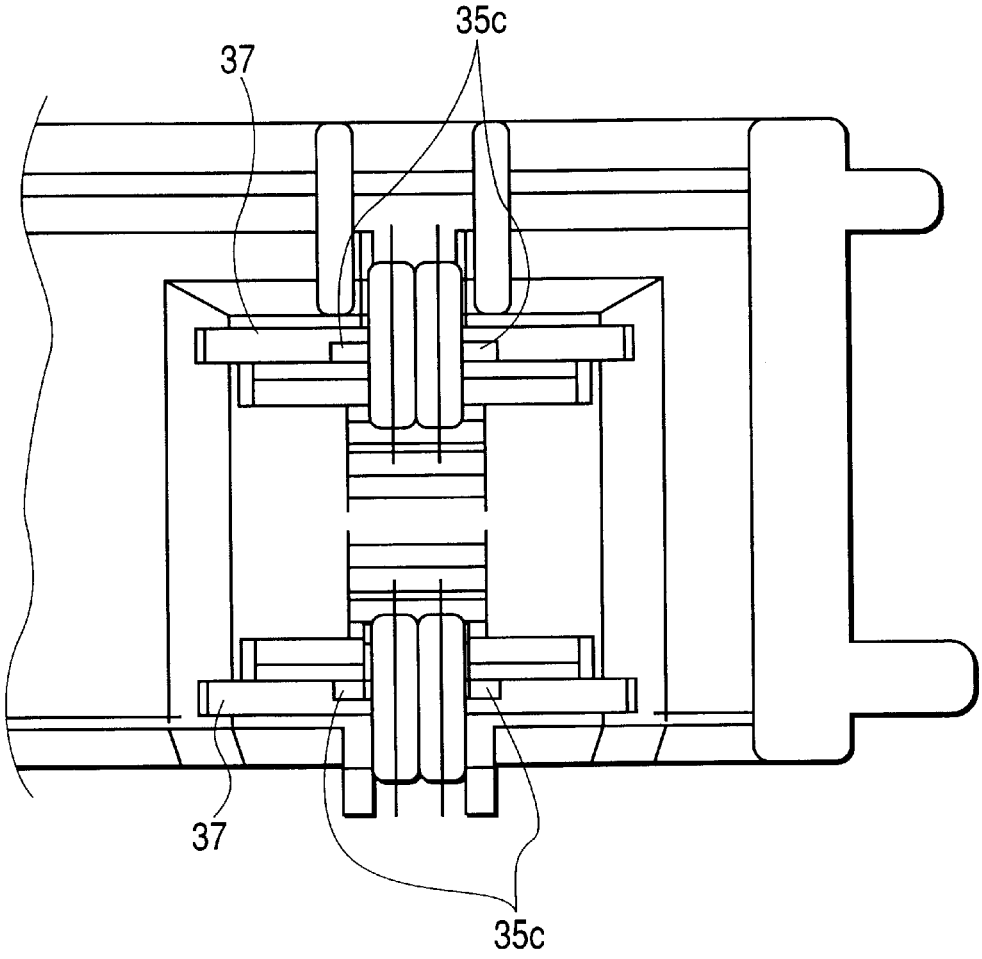
FIG. 4 is a view that schematically shows the spur base of the ink jet recording apparatus represented in FIG. 1, observed from the bottom thereof.
Figure 5A:
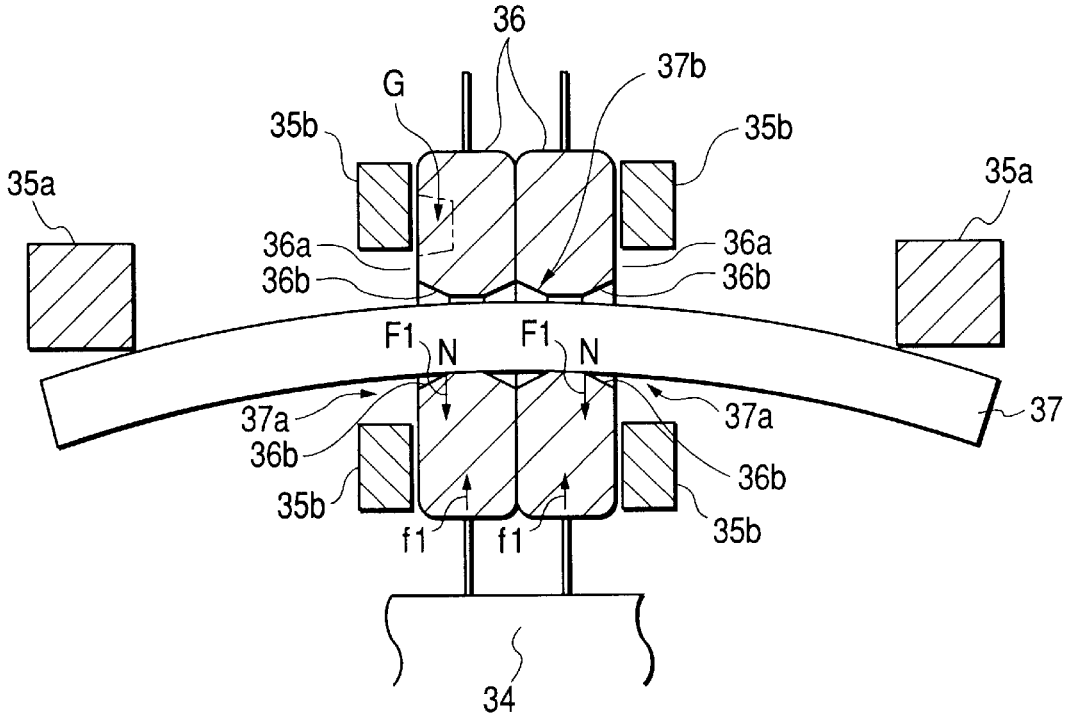
FIGS. 5A and 5B are cross-sectional views that schematically illustrate the spur structure of the ink jet recording apparatus represented in FIG. 1.
Figure 5B:
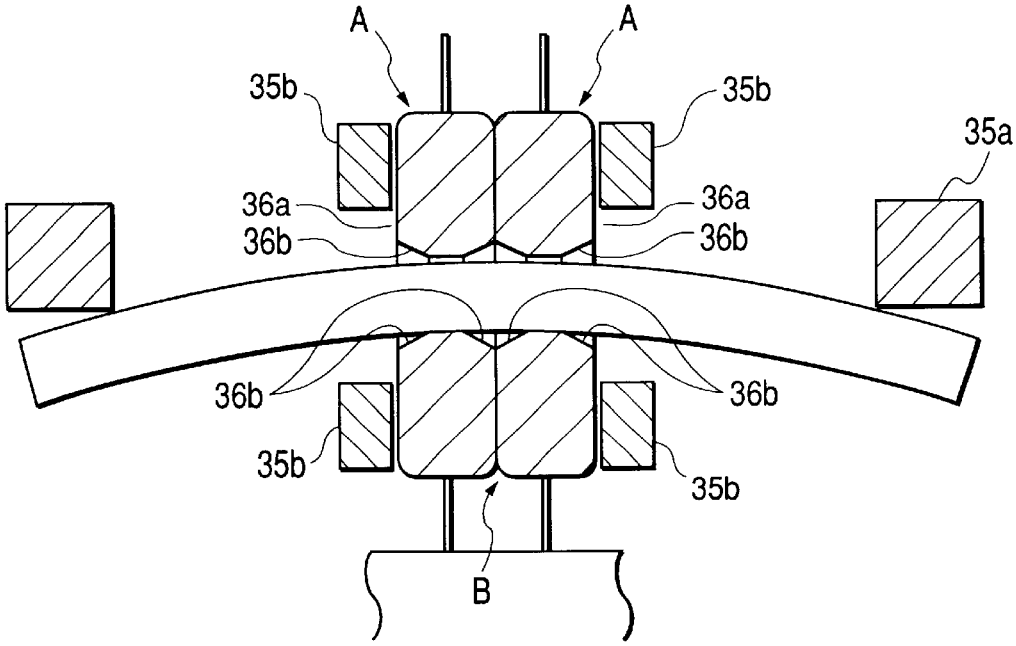
Figure 6A:
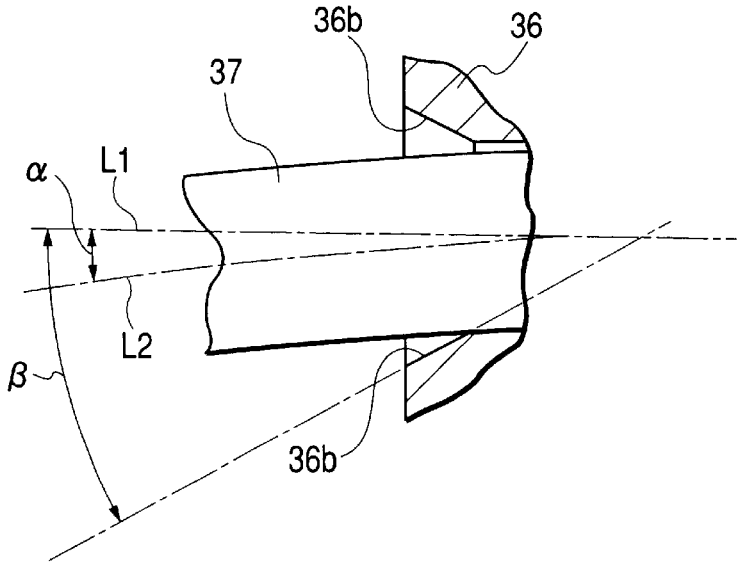
FIGS. 6A and 6B are cross-sectional views that schematically illustrate the side face escape of the spur of the ink jet recording apparatus represented in FIG. 1.
Figure 6B:
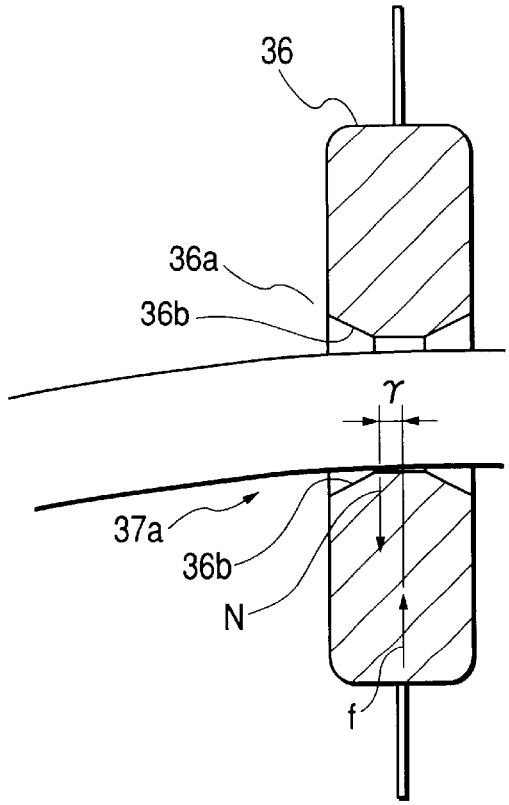

Next, with reference to FIG. 3 to FIGS. 6A and 6B, the description will be made of the spur structure embodying the present invention. FIG. 3 is a view that shows the expeller portion observed from the front side. FIG. 4 is a view of the structure of the spur base 35, which supports the spur 36, observed in the direction indicated by an arrow A in FIG. 3. FIGS. 5A and 5B are cross-sectional views that schematically illustrate the center of the spur. FIGS. 6A and 6B are views that illustrate the side face escape of the spur.

In FIG. 3 to FIG. 5A, the spur 36 is made in such a manner that a sheet material is prepared by etching a stainless steel plate in a thickness of 0.3 mm or less to be in a designated shape (as shown in FIG. 11A, the edge of the circumference of a circular plate is formed with irregularities, and the convex portion thereof is made to be extruded), and then, the width (thickness) is formed to be in a thickness of approximately 2 mm, thus structuring the concave portion of the gate G in order to avoid sliding of the gate portion when being formed. Then, the spur spring 37, which has a small spring constant and is formed by winding thin diameter wire, is arranged to be the rotational shaft, thus rotatively supporting two spurs in a row, while biasing them in the direction of the expeller roller 34 by means of the deformation of the spur spring 37, both ends of which are regulated by part 35*a* of the spur base 35.

Also, in order to control the spur position in the direction of the recording material conveyance, the inner diameter of the spur 36 and the outer diameter of the spur spring 37 are rotatively supported with a clearance of approximately 0.1 mm. Further, the side face 36*a* of the spur 36 is regulated by the spur base 35*b* to prevent it from falling down. Then, the elastic nail 35*c* of the spur base 35 is arranged to prevent the spur spring 37 from coming off.

In the structure described above, an escape 36*b* is formed for the spur 36, on both end portions of the spur 36 (each opening of the hole that functions as the bearing of the spur spring 37) as shown in FIG. 6A so that both ends thereof (opening portions) are prevented from being in contact with the spur spring 37. Here, the escape 36*b* is formed to satisfy $\alpha \leqq \beta$ where $\alpha$ is an angle formed by the center L1 of the rotational hole of the spur and the axial center L2 of the spring shaft, and $\beta$ is an angle formed by the center L1 of the bearing hole of the spur and the escape 36*b* of the spur 36, and also, as shown in FIG. 6B, the amount $\gamma$ of displacement between the biasing portion N of the spur spring 37 to the spur 36 and the acting line of reaction f is set to be within 0.635 mm (1/40 inch).

Figure 10:
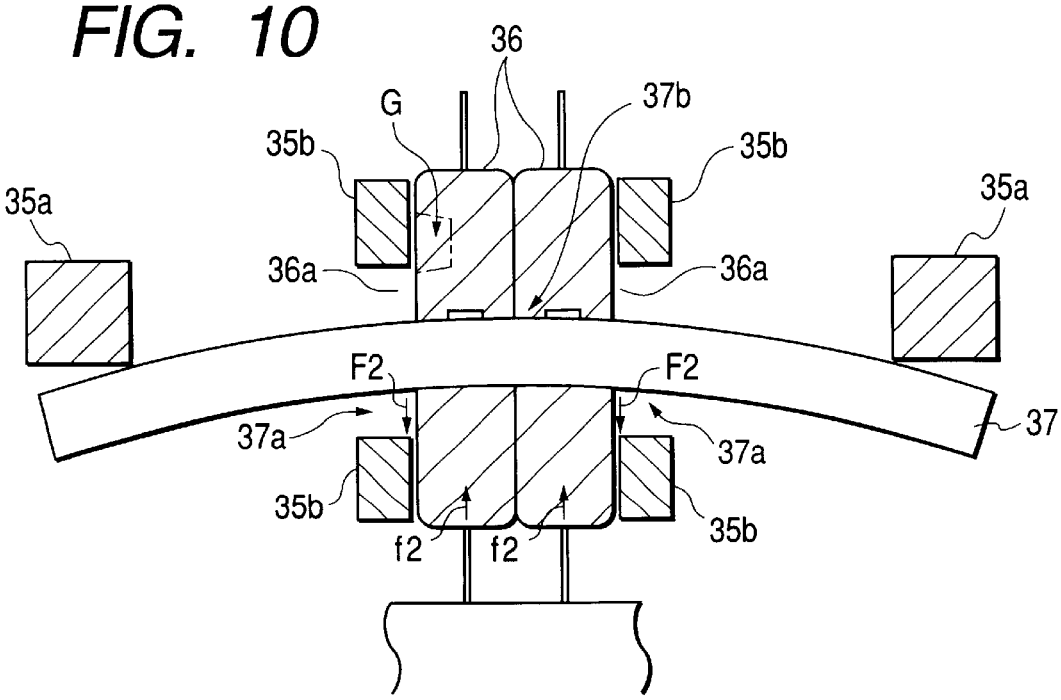
FIG. 10 is a cross-sectional view that shows the conventional spur structure.

In the structure that does not provide any escape, such as the conventional structure (FIG. 10), the inner side edge portion 37*b* is in contact with the inner circumference of the spur 36 when being biased at the outside edge portion 37*a* with the amount of deformation of the spur spring 37 being approximately 1 mm. Then, the resultant rotational load of the spur 36 is made large.

In accordance with the present embodiment, however, the structure is arranged to provide the escape portion 36*b* for the spur 36. Then, the spur 36 and the spur spring 37 exert the force F1 that biases the spur 36 only on the biasing portion N, thus making the rotational load of the spur 36 small.

Also, the biasing portion N is positioned beyond the distance ($\gamma$), which is within 0.635 mm (1/40 inch) from the acting line of the reaction f to the spur 36, thus making the amount of displacement vector small with respect to the conflicting biasing force F1 and the reaction f1 in the direction from the expelling roller 36. Then, it becomes possible to significantly reduce the rotational moment exerted by this displacement from the rotational moment exerted by the conventional biasing force F2 and reaction f2. Therefore, as shown in FIG. 5B, the sliding load can be reduced between the spur side face 36*a*, the spur base 35*b*, and the spurs 36 themselves at the points A and B generated by the inclination of the spur 36 caused by the biasing force F and the reaction f.

In this respect, according to the experiments, it is confirmed that in a system having the spur diameter of $\Phi$ 5 mm to 15 mm with the spur width (thickness in the axial direction) of approximately 2 mm, the contact marks of the extrusions of the spur to a recording material can be prevented in an excellent condition if the biasing portion N is in a position within 0.635 mm (1/40 inch) from the acting line of the reaction f.

As described above, with the escape portion 36*b* formed on the side face of the spur 36, which is arranged to be $\alpha \leqq \beta$ on the biasing portion N of the spur 36 provided by the spur spring 37, it becomes possible to significantly reduce the contact marks of the extrusions of the spur (the contact marks between the circumferential edge of the rotational member and a recording material when using the rotational member having the curved circumference), while attaining the stabilized conveyance by reducing the rotational load of the rotational member. Further, by positioning the biasing portion N to be within 0.635 mm (1/40 inch) from the action line of reaction f exerted by the expelling roller 34, it becomes possible to further reduce the rotational load on the rotational member, and to attain further stabilization of the conveying capability.

Here, for the recording apparatus embodying the present invention, the description has been made of a structure in which two spurs 36 are arranged in line. However, the same effect is obtainable in a structure where one spur 36 is arranged.

Figure 7:
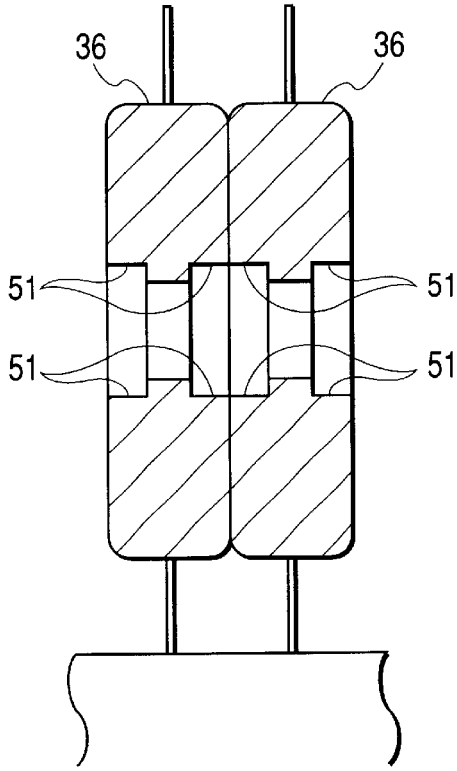
FIG. 7 is a cross-sectional view that schematically shows the spur structure in accordance with another embodiment of the present invention.
Figure 8:
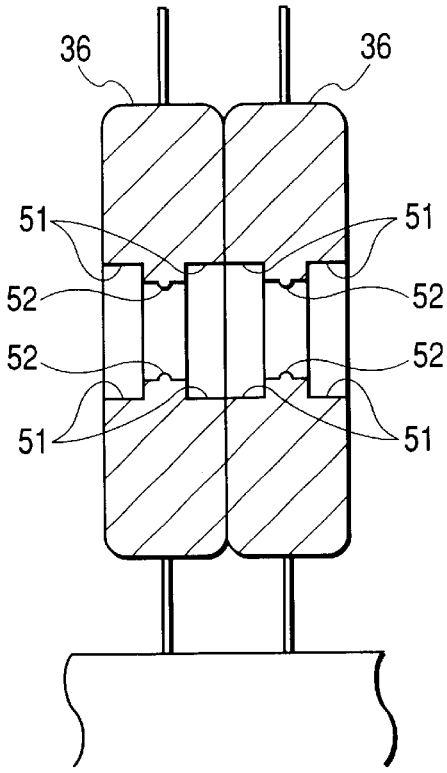
FIG. 8 is a cross-sectional view that schematically shows the spur structure in accordance with still another embodiment of the present invention.
Figure 9:
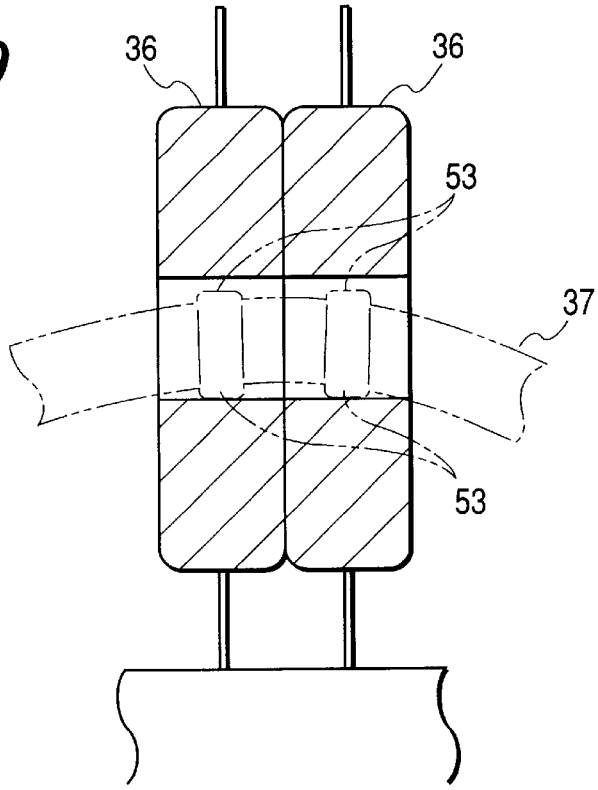
FIG. 9 is a cross-sectional view that schematically shows the spur structure in accordance with a further embodiment of the present invention.

Next, in conjunction with FIG. 7 to FIG. 9, the description will be made of the ink jet recording apparatus in accordance with another embodiment of the present invention. FIG. 7 to FIG. 9 are cross-sectional views that illustrate various spur structures in accordance with the other embodiments of the present invention. For the portions that overlap with the description of the aforesaid embodiment, the same reference characters are provided, and the description thereof will be omitted.

Here, also, the description will be made of the embodiments in which a spur type rotational member is used as the rotational member of the rotationally conveying portion for expeller use. However, the same effect can be demonstrated by use of the rotational member that has the curved circumferential surface.

Another embodiment shown in FIG. 7 is such that the configuration of the escape portion 36*b* of the spur 36 of the aforesaid embodiment is arranged to be an escape portion 51 having a column type cut-off.

Also, still another embodiment shown in FIG. 8 is such that the escape portion 36*b* is arranged like the escape portion 51, while providing an extrusion 52 for the biasing portion N. In this manner, the biasing portion is made extremely small. The extrusion 52 biases the spur spring 37 to make it possible to deal with selection of specifications of the recording apparatus, as well as selection of molding material or the like, although the durability is slightly lowered.

Also, a further embodiment shown in FIG. 9 is such that the inner diameter of the spur 36 is made larger than the outer diameter of the spur spring 37, and a large diameter portion 53, which corresponds to a part of the biasing portion N of the spur spring 37, is provided.

In accordance with these structures, it is made possible to significantly reduce the contact marks of the extrusion of the spur (the contact marks between the circumferential edges of a rotational member when using a rotational member with curved circumferential surface), while attaining the stabilized conveyance capability by reducing the rotational load of the rotational member as in the case of the first embodiment. It is also made possible to select the configurations of the spur and spur spring depending on the required specification of a recording apparatus, as well as depending on the cost of manufacture or the like.

As described above, in accordance with the embodiments hereof, the biasing shaft member is provided with an escape portion so as not to give any interference on both edge portions of the hole at the rotative center of a rotational member, hence reducing the sliding load of the rotational shaft portion, and also, reducing the sliding load on the side face due to the inclination of the rotational member that may take place. In this way, it becomes possible to significantly reduce the rotational load of the rotational member that may cause breakage or damage of a recording material by the rotational member for expeller use or result in the occurrence of stains and other contamination. Further, by the reduction of the rotational load of the rotational member, it is made possible to secure the capability of performing stable conveyance, in addition to the aforesaid capability of reducing the breakage of recording material by the rotational member for expeller use, and the occurrence of contamination, such as stains.

What is claimed is:

1. A recording material conveying device comprising:

a pair of rotational members for conveying a recording material; and an axial member for supporting one rotational member of said pair of rotational members, wherein given an angle formed by the center of a hole serving as a bearing for said axial member and an axial core of said axial member inserted through said hole is $\alpha$, and an angle formed by the center of said hole and an escape portion provided for the opening portion of said hole for avoiding contact between said rotational member and said axial member is $\beta$, the formation of said escape portion and said opening portion satisfies a condition of $\alpha \leqq \beta$ for the rotational member supported by said axial member.

2. A recording material conveying device according to claim 1, wherein a portion of said axial member that supports the rotational member is within a distance of 0.635 mm from an acting line of reaction received by the rotational member.

3. A recording material conveying device according to claim 1, wherein the rotational member supported by said axial member is a spur having plural extrusions on the circumference thereof.

4. A recording material conveying device according to claim 1, wherein the rotational member supported by said axial member is conveying means for recording on the trailing end of a recording material and expelling a recording material.

5. A recording material conveying device according to claim 1, wherein the rotational member supported by said axial member is a driven expeller rotational member to be in contact with the recording surface of a recording material after ink jet recording.

6. A recording material conveying device according to claim 1, wherein said axial member is a spring shaft having a circular outer diameter formed of closely wound spring wire.

7. An ink jet recording apparatus for recording by discharging ink droplets from an ink jet recording head to a recording material, comprising:

a pair of rotational members arranged on the downstream side of said ink jet recording head in the conveying direction of a recording material for conveying the recording material; and an axial member for supporting one rotational member of said pair of rotational members, wherein given an angle formed by the center of a hole serving as a bearing for said axial member and an axial core of said axial member inserted through said hole is $\alpha$, and an angle formed by the center of said hole and an escape portion provided for the opening portion of said hole for avoiding contact between said rotational member and said axial member is β, the formation of said escape portion and said opening portion satisfies a condition of $\alpha \leqq \beta$ for the rotational member supported by said axial member.

8. An ink jet recording apparatus according to claim 7, wherein a portion of said axial member that supports the rotational member is within a distance of 0.635 mm from an acting line of reaction received by the rotational member.

9. An ink jet recording apparatus according to claim 7, wherein the rotational member supported by said axial member is a spur having plural extrusions on the circumference thereof.

10. An ink jet recording apparatus according to claim 7, wherein the rotational member supported by said axial member is conveying means for recording on the trailing end of the recording material and expelling the recording material.

11. An ink jet recording apparatus according to claim 7, wherein the rotational member supported by said axial member is a driven expeller rotational member to be in contact with the recording surface of the recording material after ink jet recording.

12. An ink jet recording apparatus according to claim 7, wherein said axial member is a spring shaft having a circular outer diameter formed of closely wound spring wire.

* * * * *

UNITED STATES PATENT AND TRADEMARK OFFICE

CERTIFICATE OF CORRECTION

PATENT NO. : 6,851,801 B2
DATED : February 8, 2005
INVENTOR(S) : Niikura

It is certified that error appears in the above-identified patent and that said Letters Patent is hereby corrected as shown below:

Title page,
Item [56], References Cited, U.S. PATENT DOCUMENTS, add the following:

| | | |
|---|---|---|
| -- 5,805,176 | 9/1998 | Saito et al. |
| 5,961,234 | 10/1999 | Uchikata --. |

Insert the following:

-- FOREIGN PATENT DOCUMENTS

| | | |
|---|---|---|
| 0 161 694 | 11/1985 | European Patent Office |
| 2-41277 | 2/1990 | Japan --. |

Signed and Sealed this

Eighteenth Day of October, 2005

JON W. DUDAS
*Director of the United States Patent and Trademark Office*